US005619799A

United States Patent [19]

Keung-Lung et al.

[11] Patent Number: 5,619,799

[45] Date of Patent: Apr. 15, 1997

[54] THREE-DIMENSIONAL PATTERN DESIGN METHOD FOR GARMENTS FITTED WITH SLEEVES

[75] Inventors: Alexandre K. Keung-Lung, Bernay; Dominique Longavesne, Grandchain, both of France

[73] Assignee: TPC International, Paris, France

[21] Appl. No.: 409,152

[22] Filed: Mar. 23, 1995

[30] Foreign Application Priority Data

Sep. 23, 1992 [FR] France ..... 92 11510

[51] Int. Cl.[6] ..... A41H 3/00

[52] U.S. Cl. ..... 33/11; 33/17 R

[58] Field of Search ..... 33/11, 12, 17 R, 33/17 A, 16

[56] References Cited

U.S. PATENT DOCUMENTS

| | | | |
|---|---|---|---|
| 266,137 | 10/1882 | Groves | 33/12 |
| 2,762,124 | 9/1956 | D'Angelo | 33/16 |
| 3,369,300 | 2/1968 | Green | 33/17 R |
| 4,856,196 | 8/1989 | Ajus et al. | 33/11 |
| 4,894,918 | 1/1990 | Huang | 33/12 |

FOREIGN PATENT DOCUMENTS

| | | | |
|---|---|---|---|
| 971237 | 11/1982 | U.S.S.R. | 33/17 R |
| 1031430 | 7/1983 | U.S.S.R. | 33/17 R |
| 1120962 | 10/1984 | U.S.S.R. | 33/12 |
| 14390 | 7/1909 | United Kingdom | 33/12 |

*Primary Examiner*—Christopher W. Fulton
*Attorney, Agent, or Firm*—Horst M. Kasper

[57] ABSTRACT

A three-dimensional pattern design method for garments fitted with sleeves concerns a general pattern method for speedily designing garments for men, women and children without further alterations being required. The method is characterized by the use of a particular structural line (A1-G-A3) determined by the body's morphology and attitude, by specific proportional calculations of the waistline, the collar and shoulder slope using reference values (Vx, Vy), by a specific relational and three-dimensional calculation of the armhole-sleeve fitting using transfer lines (G-C, G-C1) defining a reference value (Vz), by the calculation of two tension points (P, P1) for enabling a proper fitting of the garment to the shoulder, and by a single drawing line incorporating all the garment's basic components into the assembly plan. The method according to the invention is especially suitable for use in the dressmaking industry.

8 Claims, 4 Drawing Sheets

THREE-DIMENSIONAL PATTERN DESIGN METHOD FOR GARMENTS FITTED WITH SLEEVES

FIELD OF THE INVENTION

The subject of the present invention is a method for designing patterns for pieces of garments with sleeves, especially jackets, blazers, coats, overcoats, dresses, shirts and blouses for men, women and children without a limitation in length and in any material with warp and weft, made of natural or synthetic fibers, or of leather.

BACKGROUND OF THE INVENTION

The design of a garment pattern is the operation which consists in drawing the manual or computerized outline of a geometric architectural construction connected with given structural references. The particular contours obtained as well as certain specific reference marks internal or external to the outline, determined on the basis of the main anatomical points of the human body, define the basic image of the constituent figures of a garment, by means of an accurate drawing. All of these various drawn pieces together form the pattern or basic design of the future garment. Subsequently, on the basis of this outline, the technician or designer will cut out the pieces from the materials chosen to make the garment.

Traditionally, two distinct methods are used for producing a basic design, the flat construction technique and the technique of modelling on a mannequin. The use of one or other of these methods or both simultaneously is applied depending on the objectives to be achieved and as a function of the chosen path: craftsmen, cottage industry or industrial-scale. The combined practice of both techniques often proves necessary in a search for a complement relative to the mutual theoretical or practical advantages or disadvantages of each method.

Construction using modelling, a technique which goes way back and is still very widely used in haute couture, by designers, and by craftsman tailors, has the advantage of giving an overall view of the desired volumes, makes it possible to capture the first silhouette and allows a wide degree of creative expression right from the inception of the design. However, this technique naturally lacks accuracy, and plays with the stylishness of the garment without true logical progression, and shows the physical appearance of the design without any true ability to finalize it. In this sense, construction using volume still requires subsequent flat adjustment.

The forced association of the two methods bears witness to their mutual technical weaknesses. Neither is any longer sufficient for the requirements of modern industrial-scale manufacture or for the diversified and rapidly-changing nature of today's fashions.

Traditional flat construction provides a method for applying measurements and calculations which gives the outline relative precision. The practical procedure is carried out in the first instance by drawing the reference structures or construction lines based on the anatomical points and then by drawing the required shapes: neck, armholes, shapes of forks, lines and various curves. The outline of the elements for putting together and finishing the seams and tucks completes the procedure. This path is often undertaken according to a given method on the basis of the required measurements for a reference base.

This system allows two-dimensional drawing, piece by piece, of a base intended for industrial-scale manufacture. Nevertheless, the technique remains complicated, rigid, and with a limited creative expression, mainly owing to the numerous mathematic or geometric calculations inherent to the method. What is more, all the pieces are designed separately and the transferring of curves for the assemblies is done using calculations of outlines which are relatively approximate and somewhat incoherent. The use of this method results, for example, in no original harmonious link connecting collar and neck, sleeve and armhole and possible proportional fitting. The result obtained masters the notion of balance, control of volume and of shape only with difficulty. The same is true of the mastering of the fullness, of the orientation and forwardness of the sleeves as well as of the position of the seams. The weakness of the method is demonstrated with the difficulty in joining together seams which are biased at various degrees with certain materials such as, for example, polyester microfibers.

In general, the application of the traditional flat construction method does not allow the fundamental principle of the "comfort" of the garment to be attained effectively and, in order to meet the requirements of modern industrial-scale manufacture necessitates a very excessive production lead time. Through the need of having to conduct numerous tests and make numerous prototypes and subsequent modifications, the two abovementioned construction methods all too frequently lead to a loss in time and viability.

Such a traditional and two-dimensional method intended for producing a pattern for pieces of garments with sleeves, especially of jackets, blazers, coats, overcoats, dresses, shirts and blouses is described, for example, in the document FR-A-560,154 which dates from 1992. This method is based solely on the measurements taken on the subject, to the exclusion of the so-called "proportion" measurements. It can thus easily be seen that this method has no industrial-scale application.

SUMMARY OF THE INVENTION

The present invention aims precisely to alleviate the abovementioned drawbacks and to allow the design of patterns for pieces with sleeves for men, women and children without any limitation in length and made of any material made of natural or synthetic fibers or of leather.

The present invention therefore relates to a method for designing three-dimensional patterns for pieces of garments with sleeves, especially jackets, blazers, coats, overcoats, dresses, shirts and blouses for men, women and children without any limitation in length and from any material with warp and weft, made of natural or synthetic fibers or of leather, according to which method a plurality of structural lines are drawn first of all, especially the waist line, the length lines, the neck lines, the hip line and the pelvis line.

According to the invention in order to obtain a structural outline:

a theoretical axis of the profile of the bust is drawn by means of a line made of two segments, which is broken at a specific point known as the point of gravity, marking the angle of projection of the pelvis forwards and, by reaction, inclined backwards by 6° to 8° in its upper segment, this line constituting the fundamental reference line for constructing the garment, and being termed body line;

the specific position of the sleeve is determined symmetric to the upper segment of the reference line;

a first reference value (Vx) is determined by drawing a theoretical straight line perpendicular to the waist line, this value lying between the point of intersection of this theoretical line and the waist line, and the point of intersection of the back sleeve orientation line and the waist line;

a specific and proportional geometric calculation is carried out on the fitting of the waist, using the first reference value (Vx);

a second reference value (Vy) is determined on the center-front line using the difference lying between the points where it passes through the theoretical height of the neck back and the shoulder front line, this difference determining, in ordinates, the exact second reference value (Vy), a specific and proportional geometric calculation is carried out between the neck, neck length and shoulder slope points with the aid of said second reference value (Vy);

a specific three-dimensional and relational geometric calculation is carried out on the armhole/sleeve fitting with the aid of curve transfer lines consisting of the tangents to the armhole originating from said point of gravity which results in defining a third specific reference value (Vz);

two tension points denoted respectively back hanging point and front hanging point are determined, and these make it possible to fine-tune the fitting of the pattern in order to obtain integral fitting of the garment on the shoulder, through a specific calculation on the theoretical back shoulder slope at the intersection of a straight line originating from the center of the back shoulder line and perpendicular to the theoretical neck line, and the distance between the back hanging point and the point of intersection of the back shoulder line and of the upper segment of the body line is transferred onto the theoretical front shoulder slope starting from the point of intersection of the shoulder line and of the upper segment; and the bust dart value is specifically taken in making it possible to eliminate or use up any excess material depending on the desired volume.

All the components of the garment fall within the construction plan.

This structural original outline is the result of practical conclusions originating from a precise observation of contemporary morphology overall. The observation relates to a substantial modification in the attitude of the body through a generally accentuated curvature of the back. On the basis of this new phenomenon, in-depth research has defined, along the axis of the profile of the body, a theoretical point of gravity which is situated on the waist line. This point marks the angle of projection of the advancement of the pelvis and, by reaction, of the tipping of the torso backwards to a mean extent of between 6° and 8°.

According to the invention, this characteristic, right from the design of the structure, gives priority to the "comfort" of the garment, avoids the drawbacks of the usual methods which have difficulty in mastering both balance and style, and establishes the balance of the garment and makes it considerably easier to grade it into sizes at a later date.

The proportional fitting value termed Vx is applied as a fundamental rule for obtaining good placing of the warp and weft lines, ensuring that the back and front pieces hold together well, and thus, right from the basic outline, participates in the easing and elegance of the garment.

The proportional value termed Vy is applied regardless of the size or design envisaged, allows more accurate fitting of the garment in the region of the aforementioned support or passage regions, while eliminating a substantial part of the constraints which are due to the bending forwards or backwards movements, which movements cause an increase and decrease in the front torso length or back torso length. This characteristic according to the invention more particularly allows the correct positioning of the neck and of the shoulder slopes to be controlled, which is the essential basis of any successful gradation.

By virtue of the technical possibilities given by the invention, depending on the style or desired appearance, the position of the sleeve may be in accordance with the appended drawings or vary to the following extents: 22.5°–30°–45°–67.5°–90°.

This characteristic according to the invention allows precise calculation of the way the garment has to be fitted with easing of the movements of extending and of retracting the arm.

The two theoretical points defined by an accurate specific calculation and termed hanging points are situated respectively on the back shoulder slope line and on the front shoulder line. These particular tension points make it possible to fine-tune the outline of how the garment fits onto the shoulder in the region of the fastening areas and thus to contribute to overall "comfort".

Right from the basic outline, the method allows all the components of the garment to lie within the construction plan, allows identical seams to be obtained as a matter of course by simplifying the development of the industrial pattern, thus making the calculation of approximate outlines unnecessary, establishes balance right from the beginning and makes gradation easier by connecting it closely with the construction plan. It controls the fullness connected with the joining-together of the sleeve head and armhole and mainly masters the sewing of seams which are "biased" to various extents.

The aesthetic advantages connected with the method allow control over the volume and over the desired shape, and perfectly master both the balance and the style and, right from the inception of the structure, give priority to the "comfort" of the garment.

BRIEF DESCRIPTION OF THE DRAWINGS

The invention will be better understood, and other objectives, advantages and characteristics of it will emerge more clearly from reading the description which follows of the preferred embodiments which are given with no limitation implied, and to which four plates of drawings are appended, in which.

DESCRIPTION OF THE PREFERRED EMBODIMENT

According to the detailed description which follows, the contour of each piece is established on the basis of a series of geometric calculations carried out according to a particular procedure, determined by the characteristics of the invention.

Figure 1:
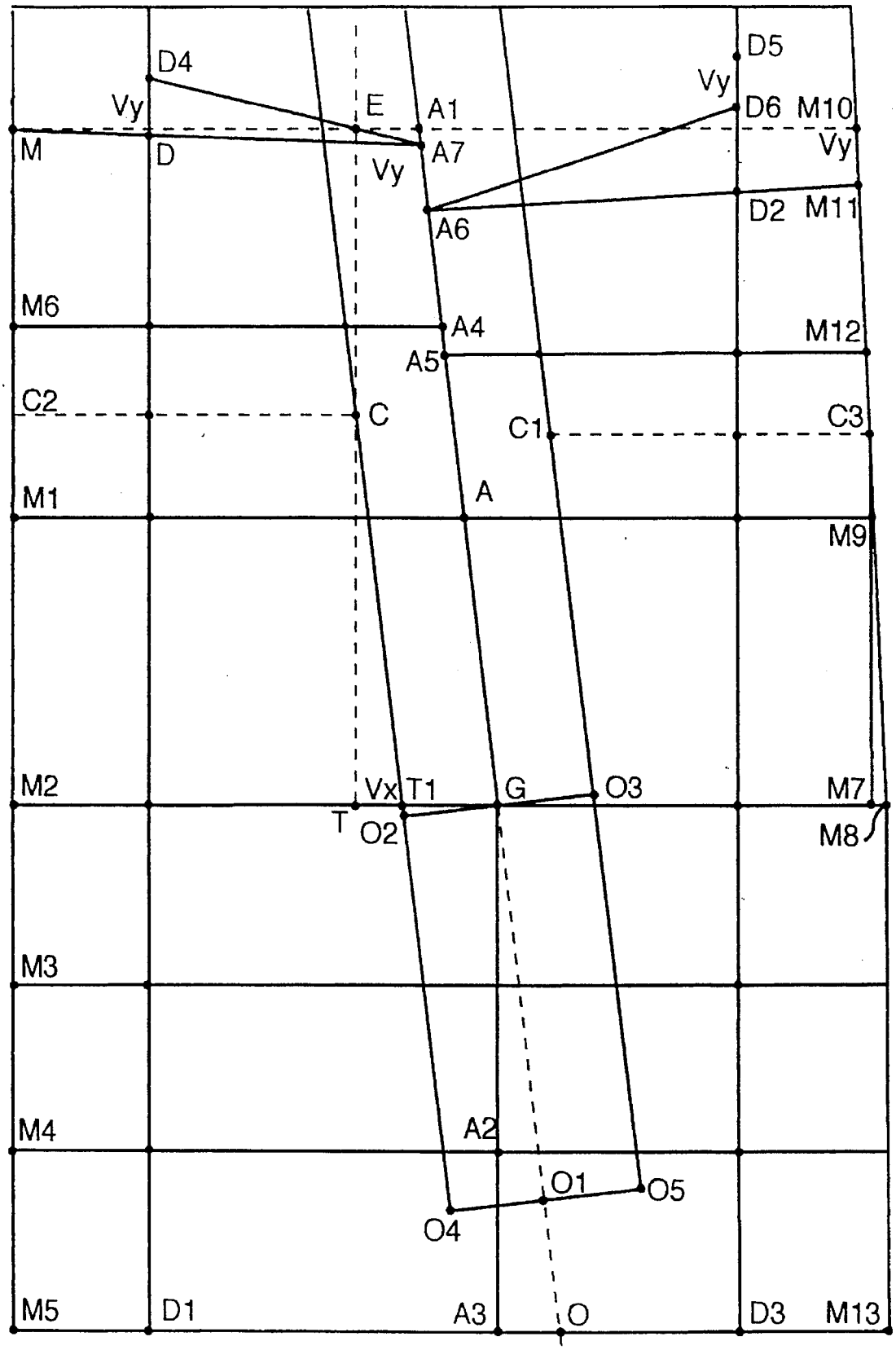
FIGS. 1 to 4 represent one example of the progressive application to a flat construction plan of the various characteristics of the method for designing three-dimensional patterns for a basic style of jacket with sleeves, size 38–40, for a woman 1.65–1.68 meters tall. The style represented includes three distinct constituent pieces: half back, half front and sleeve.

According to FIG. 1, first of all the horizontal structural lines are drawn on a 1000×1000 mm medium using the following precise measurements: waist line 550 mm from the upper edge of the medium, all the other horizontal references will be drawn parallel to this line. The length-of-back line 175 mm from the waist and the dotted back neck line 405 mm from the waist. This line is a theoretical reference based on a waist-back height and waist-front height which are different. The outline continues with the hip line 110 mm from the waist, the pelvis line 210 mm from the waist, and the finished length 315 mm from the waist, that is a total height of 720 mm from the upper line to the lower line. According to the invention, having drawn the structural lines, the pivot point or point of gravity denoted point G 450 mm from the left edge of the medium is determined on the waist line. The off-center position obtained is explained through the need to allocate a larger drawing area to the front part than to the back part on the basis, depending on the desired design, of any possible particular originality or cross.

Still according to the invention and as indicated before, starting from the point G a straight line is drawn inclined by 6° to 8° backwards towards the center back. For the present demonstration, an inclination of 7° has been chosen, as featured in the appended drawings. This straight line reaches the length-of-back and back neck lines at points A and A1. Then, a perpendicular to the waist line is drawn from the point G towards the finished length. This straight line intersects the pelvis line at A2 and reaches the finished length at A3. The line constructed passes through the points A1, A, G, A2, A3, corresponds to the morphological attitude, bears the initials thereof and is denoted body line. Next, the dotted line for the line known as sleeve orientation line is drawn, as an extension of A1-G towards the finished length as far as the point denoted O with reference to the orientation of the sleeve. The line obtained A1-G-O, denoted reference line is, according to the invention, the fundamental characteristic of the construction plan described here.

The sleeve length is calculated for a measurement of 240 mm. This dimension is taken from the point G to the point O1 on the sleeve orientation line.

The sleeve-back orientation line and the sleeve-front orientation line are determined by drawing two parallel lines 60 mm on either side of the reference line AI-O. The value of 120 mm obtained corresponds to an armhole opening for a size 40 sleeved jacket.

Passing through O1, a perpendicular to the sleeve orientation line marks the physical length of the sleeve at O4 and O5. Then, passing through G, a perpendicular to AI-O marks the length of the elbow at O2 and O3. Thus the advancement of the square for the armhole, and the position and orientation of the sleeve are obtained by means of the points O2, O3, O4 and O5.

The back breadth height point A4 is situated on the body line A1-G halfway up the length of the back, that is at a distance of 115 mm from A and A1. The front breadth height point corresponds to a front length height of 195 mm, decreased by half, that is a point A5 situated 97.5 mm from the point A.

The back hinge point C is situated on the back sleeve orientation line 57.5 mm from the intersection with the length line. This distance corresponds to one quarter of the length-of-back. The front hinge point C1 is situated on the front sleeve orientation line 48 mm from the intersection with the length line. This distance corresponds to a quarter of the length of the front. The two points are denoted C1 with reference to hinge points.

According to the invention, as demonstrated later, the value denoted Vx is used for the proportional calculation of the fitting. It is obtained by drawing a theoretical line T-C perpendicular to the waist line. The value Vx lies between the point T and T1 situated at the intersection of the back sleeve orientation line and the waist line. As indicated before, this reference value is one of the fundamental characteristics of the method detailed and given here.

The shoulder width depends on the style. In the example given, a size 40 corresponds to a bust measurement of 87–88 cm. In order to obtain the exact shoulder width, a quarter of this measurement, namely 220 mm, is applied to the theoretical neck line towards the center back as far as the point M. The point is denoted M with reference to the center back and center front defined later. It is the center point of the back neck and the measurement which separates it from the extended line T-C is the shoulder width.

The center back "seam" line is a straight line originating from the point M and perpendicular to all the horizontal structural lines. It crosses the length line at M1, the waist line at M2, the hip line at M3, the pelvis line at M4 and the finished length at M5.

Drawn from A4 to M6, the back half length line determines half the length of the back. Parallel to the length line it will be used as a notching reference for future joining-up.

The dotted theoretical back half-breadth line is drawn in parallel with the height line, from the hinge point C as far as the center back line at C2. The width of the back half-breadth is 220 mm. In order to draw the dotted theoretical front half-breadth line, the width of the back half-breadth decreased by one tenth and rounded up to the next figure, namely 200 mm is transferred from the front hinge point C1 towards the center front as far as the point C3. This line is parallel to the length line and its measurement indicates the width of the front half-breadth.

The center front line is drawn by means of a dotted theoretical perpendicular to the waist line, starting from C3 as far as M7. From M7, a value of 10 mm outwards on the waist line marks the point M8. A vertical line starting from M8 and passing through C3 as far as the theoretical back neck line is then drawn. Its intersection with the length line is marked by a point M9 and by a point M10 at the intersection with the neck line. Next, a perpendicular to the finished length is drawn from M8. Their intersection is marked with the point M13. The center front line thus formed passes from top to bottom through the points M10, C3, M9, M8 and M13.

The front length is determined on the center front line from M9 to M11, by the previously-given measurement of 195 mm.

In order to obtain the half length, the point M12 is positioned very accurately halfway along the measurement M9-M11, namely 97.5 mm along. Next, the point A5 is joined to the point M12 in order to draw the front half-length line.

The measurement lying between M10 and M11 constitutes the difference between the front length and the back length.

According to the invention, and as demonstrated later, the value denoted Vy for the proportional calculation of the neck point and of the shoulder slope is the exact measurement lying between M10 and M11. As indicated before, this reference value is one of the fundamental characteristics of the method detailed here.

The front shoulder line is obtained by drawing a perpendicular to M10-M12 starting from M11 as far as the body line A1-G at a point A6. The back shoulder line is obtained by transferring the value Vy, namely, as reminder, the measurement M10-M11, from A6 to A7, then by drawing the straight line M-A7.

The neck opening and the back straight grain arc obtained by transferring a measurement of 87 mm, corresponding to one tenth of the bust width in question starting from M towards A7 to a point D, and by drawing a straight line passing through D and perpendicular to all of the structural lines as far as the finished length at a point D1. This vertical line is the back straight grain line. The neck opening and the front straight grain are obtained by transferring the measurement M-D decreased by one tenth and rounded up to the next figure up, namely 79 mm, onto the front shoulder line, from M11 towards A6 as far as the point D2. Passing through D2 a vertical line is drawn perpendicular to the structural lines and ending at the point D3 on the finished length. This vertical line is the front straight grain line.

The theoretical back neck length is given by transferring the value Vy starting from D as far as D4 onto the back straight grain line D-D1. The measurement D-D4 is the theoretical back neck length. The theoretical front neck length is determined by transferring the measurement M-D onto the front straight grain line D3-D2 and upper extension and starting from D2 going as far as the point D5, and then by transferring the value Vy from D5 towards D6. The measurement D6-D2 is the theoretical front neck length. The theoretical back shoulder slope corresponds to drawing a line D4-A7. The theoretical front shoulder slope corresponds to drawing a line D6-A6. The position of the back shoulder point E is obtained at the intersection of the theoretical shoulder slope D4-A7 with the extension of the theoretical line T-C towards the back neck line M-M10.

Figure 2:
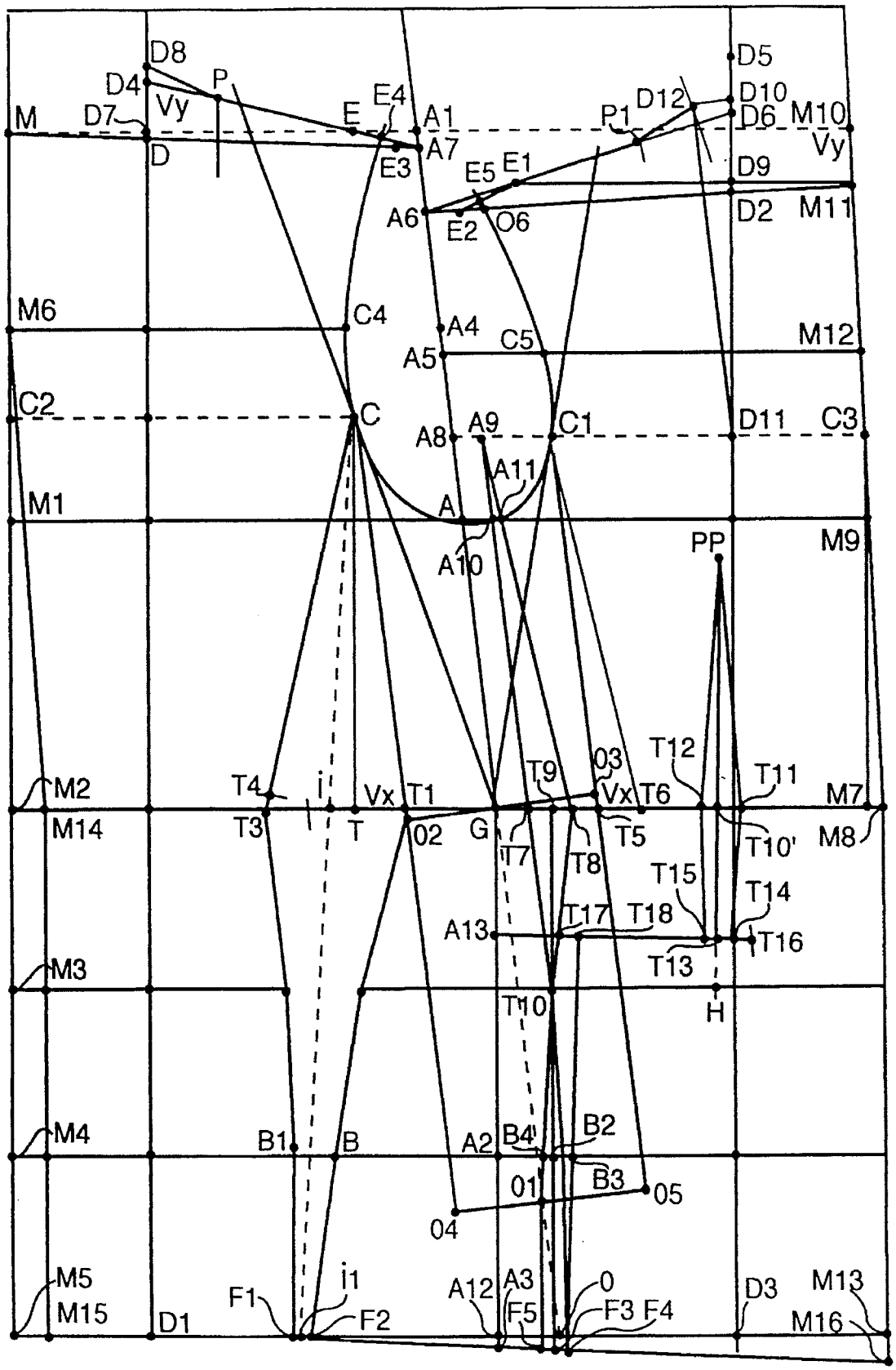

According to FIG. 2, the back hanging point is sought starting from a point situated midway along the line M-A7. From this point, a perpendicular to the theoretical back neck line M-A1 is drawn. Its intersection at P with the theoretical back slope D4-A7 marks the location of the back hanging point. Transferring the measurement A7-P onto the theoretical front shoulder slope A6-D6 marks the position of the front hanging point at P1.

Next, the back shoulder width P-E is transferred onto the theoretical front shoulder slope A6-D6 starting from the point P1 towards A6 as far as El.

The calculation for readjusting the back neck length is carried out starting from the back neck point E by drawing a theoretical dotted line E-M which marks the point D7 at its intersection with the back straight grain line D1-D4. The measurement D-D7 determines a value to be added to the previous theoretical length by positioning the value Vy D-D4 at D7-D8. The point D8 obtained is joined to the hanging point P. The readjusted back neck length defines a new back shoulder slope by means of the points D8-P-E.

In order to readjust the front neck length, a theoretical line is drawn from the front neck point E1 as far as the point M11 situated on the center front line. The point D9 marks its intersection with the front straight grain line D6-D3. The measurement lying between D2 and D9 defines the added amount of the new front neck length through its transfer from D6 to D10 on the front straight grain.

According to the invention, the amount to be taken in in the bust dart is calculated starting from the intersection D11 of the front straight grain D10-D3 and of the front half-breadth line A8-C3. From D11 taken as a center, a circular arc a few centimeters long is drawn towards the body line starting from D10. Next, the back shoulder slope length E-D8 is transferred onto the front shoulder slope A6-D6 using a compass. Using E1 as the center, a circular arc intersecting the first one at D12 is drawn. The measurement D10-D12 corresponds to a balanced amount by which to take in the bust dart and the new front shoulder slope follows the points D12-P1-E1.

The definitive front shoulder slope is sought starting from the intersection marked O6 between the front sleeve orientation line and the front shoulder line A6-M11. The measurement O6-A6 corresponds to half the armhole. One third of this measurement starting from A6 marks the point E2. The link E2-E1-P1-D12 defines the definitive front shoulder slope.

The search for the definitive back shoulder slope is calculated by transferring the distance lying between P1 and E2 onto the theoretical back shoulder slope from the hanging point E as far as the point E4 using a compass. The link D8-P-E-E4 defines the definitive back shoulder slope. This drawing procedure determines two shoulder slopes which can be joined together extremely accurately in the future assembly of the seams, thus eliminating any risk of fullness.

According to the invention, the search for the proportional fitting of the back part is calculated by multiplying the distance value Vx of the distance T-T1 with the value 3 for obtaining the distance T1-T3.

The pelvis width is sought starting from the waist line by transferring the distance G-I onto the pelvis line, from A2 towards the center back as far as the point denoted B with reference to the pelvis. Next, the point T1 is linked to the point B using a theoretical line. Then, the broken sewing line C-T1-B of the side back as well as the theoretical axis of intersection C-I-I1 is transferred onto a working sheet of tracing paper and, by turning it over axially towards the center back, the broken sewing line on the back side C-T4-B1 is marked on symmetrically. At this point in the drawing, the very substantial difference in position of T4 relative to T3 and, to a lesser extent, of B1 relative to the pelvis line will be noted. This implies, for correct assembly of the seams, that the offset of the theoretical waist line towards the axis T1-T4 as well as the pelvis line towards the axis B-B1 needs to be marked accurately. The drawing is finished off by a perpendicular to the finished line linking F1 to B1. The construction seam line on the back side therefore passes through the points C-T4-B1 and F1. In order to finish off the drawing of the side back construction seam line, the perpendicular B1-F1 is transferred onto B as far as F2 on the finished length with the aid of the sheet of tracing paper by turning it back over axially. The side back construction seam line therefore passes through the points C-T1-B and F2. Using French curves, the line C-T4-B1-F1 is fine-tuned without losing its accuracy and its balance and is then transposed onto C-T1-B-F2. Having carried out this finalization, the construction of the back fitting is definitively established by drawing on entirely identical seams, thus giving the technician the capability of carrying out highly accurate industrial-scale assembly.

In order to draw the fitting of the center back onto the waist line starting from the point M14 situated 15 mm from M2, a parallel to the center back line is drawn as far as M15 on the finished length and the point M14 obtained is joined to the height of the half-length at M6. The whole of this definitive center-back line M-M6-M14-M15 is finalized using French curves.

At this point in the construction, a straight line is drawn starting from F2 on the finished length extending towards the center front to a point M16 situated 15 mm from M13 on the extension of the center front. This line F2-M16 must, for the balance requirement, ensure that the bottom of the garment is parallel to the ground.

According to the invention, the positioning and use of the value Vx for fitting the side front part is calculated firstly by transferring the value Vx starting from the intersection of the front sleeve orientation line O5-C1 and of the waist line marked with the point T5, as far as the point T6 towards the center front. The distance T5-T6 therefore corresponds to the fitting value for the front part. For better visualization of the shift of this value, a line is drawn from the back hinge point C1 as far as T6. It constructs a visualization triangle C1-T5-T6. The drawing is continued by extending the front breadth line C3-C1 as far as the point A8 on the body line A1-G then, starting from the point A9 which has been situated 20 mm from A8 on the front breadth line towards the center front, a parallel to the body line is drawn as far as the waist line marked T7. The value Vx lying between T5-T6 is transferred onto the waist line starting from T7 towards the center front as far as the point T8. The points A9 and T8 are then linked with a straight line. The value and position of the fitting for the side front thus corresponds to the precise measurement T7-T8. The lines A8-T7 and A9-T8 are respectively marked with the points A10 and A11 at their intersection with the length line M1-M9.

The positioning of the seam lying between the waist and finished length is sought by dividing the measurement T7-T8 into two equal parts by the point T9, and then, starting from this point T9, by drawing a theoretical dotted line perpendicular to the finished length at F3. A spread of 260/270 mm is generally allowed for a size 40. One third of this conventional measurement, namely 90 mm, determines the point T10 on the theoretical line T9-F3 starting from T9, which line is marked with a point B2 at its intersection with the pelvis line. The points B3 towards the center front and B4 towards the center back are marked 7 mm on either side of B2 on the pelvis line. Two perpendiculars to the finished length link B3 and B4 to F4 and F5, respectively, on the line F2-M16. The seam line of the side front can then be drawn through the points A9-T7-T10-B3 and F4. The seam line of the front side is drawn through the points A9-TB-T10-B4 and F5.

Using French curves, the two geometric lines obtained are fine-tuned into smooth elegant curves relating to the aforementioned passage points. In order to check the coherence of the desired result it is possible, after drawing the front side seam line TB-T10-B4-F5 situated below the waist line onto a sheet of tracing paper, to transfer it onto the side front line T7-T10-B3-F4.

The search for the value of the fitting beneath the bust starts with seeking the bust point which, for a size 40, is generally situated 260/270 mm from the neck length point. Thus, starting from the point D10 positioned on the upper end of the front straight grain, a measurement of 265 mm is determined. The separation of the bust point relative to the center front corresponds to a standard 95 mm. The perpendicular positioning of these two measurements determines the bust point PP. From the point PP a dotted theoretical parallel to the front straight grain is drawn as far as the point H on the hip line. Where it meets the waist line it is marked with the point T10'. On either side of T10', a fitting value of 10 mm positions the points T11 towards the center front and T12 towards the front side. At this point in the drawing, it is necessary to situate the positioning of the pocket thus determining the end of the fitting dart. The top of the pocket is placed generally 80 mm from the waist line, namely at a point T13 on the axis PP-H. Then, using a compass, the vertical distance lying between T13 and the finished balance line F-M16 is measured. This distance is transferred from the point marked A12, resulting from the meeting of the body line and of the finished balance F-M16, at the point A13 on the body line. A straight line 165 mm long originating from A13, parallel to the finished balance line F2-M16 and passing through T13 ends at the point T16. This line determines the width of the pocket on which, 7 mm on either side of T13, the points T14 and T15 are used to mark a value slightly less than the length T11-T12. The fitting curves for the dart are drawn and fine-tuned using French curves to pass through the points PP-T11-T14 and PP-T12 and T15. The passage of the pocket line A13-T16 through the front side seam line A9-F5 is marked with the point T17.

At this point in the construction it can be observed that the distance PP-T13 corresponds to a clearly-defined dart length but that there is an imbalance since this dart is stopped where it meets the pocket line A13-T16. It is therefore appropriate to retrieve the value T14-T15 at the top of the section T17-F5 of the front side seam. In order to do this, the value T14-T15 is placed on the pocket line A13-T16, starting from T17 towards the point T18. Then, using a sheet of tracing paper, the line T17-F5 is transferred onto T18 towards the finished balance line F2-M16 as far as the point F4. The usefulness of this operation will make it possible, after the dart T15-T12-PP-T11-T14 has been closed, to combine into one identical seam line the sections T17-F5 and T18-F4 and thus form a definitive front side seam on the basis of the points A11-T8-T17-T18-B3 and F4.

The drawing of the armhole is adjusted starting with drawing two construction lines known as transfer lines, starting from the point of gravity G towards the theoretical neckline M-M10 and passing through the back hinge point C and front hinge point C1. Then, using French curves, the armhole is drawn from C1 towards A ensuring that the limit fixed by the line G-C1 is not exceeded, in order to obtain good accuracy in the sleeve underarm part region. The drawing of the bottom of the armhole is extended by a curve which is coherent with the previous one, from A towards the back hinge point C. The upper line towards the shoulder slopes has to be continued with the aid of a sheet of tracing paper or of any other transparent medium with the right side and wrong side marked. This operation makes it possible to draw the armhole very exactly on the construction plan. The procedure is firstly, on the right side of the sheet of tracing paper, to mark on the points P and E3, the section of back shoulder slope lying between these two points, and the back sleeve orientation line starting from the hinge point C. The point C4, marking the half-breadth, and the back hinge point C are notched onto the sleeve orientation line. Next, the sheet of tracing paper is pivoted from left to right, from the previously-identified back shoulder slope towards the front shoulder slope, in order to position and mark the point E3 on E2 and the hanging point P on P1. Next, the front sleeve orientation line notched to the front half-breadth at C5 and to the front hinge point at C1 is drawn. Two shoulder slopes combined into one and two sleeve orientations which intersect very exactly thus appear on the sheet of tracing paper. With the aid of these three references it is then possible to draw the armhole as a single line from the back part to the front part. Position the French curve starting from C towards C1 passing through C4 and C5. Draw, preferably in red for good identification, a continuous and smooth armhole line C-C1. Mark its intersection with the shoulder slope with a common point E4 on the back side and E5 on the front side. Turn the sheet of drawing paper over onto its wrong side and resume the drawing of the armhole exactly. Turn the sheet of drawing paper back onto its right side again, reposition at the back part on the points C-C4-E3-E and trace off the armhole half-curve C-E4. Mark the point E4 on the construction plan. Next, undertake a similar operation for the front side, repositioning the points E2-E1-C5-C1, trace off and mark the point E5 on the front shoulder slope.

The drawing of an armhole which is visually separated but can be assembled very precisely when sewing the shoulder slopes seams is thus obtained on the construction plan. Folded over each side of the shoulder slope and, viewed from above, the armhole drawing on tracing paper is seen to be in exact linear continuity.

Figure 3:
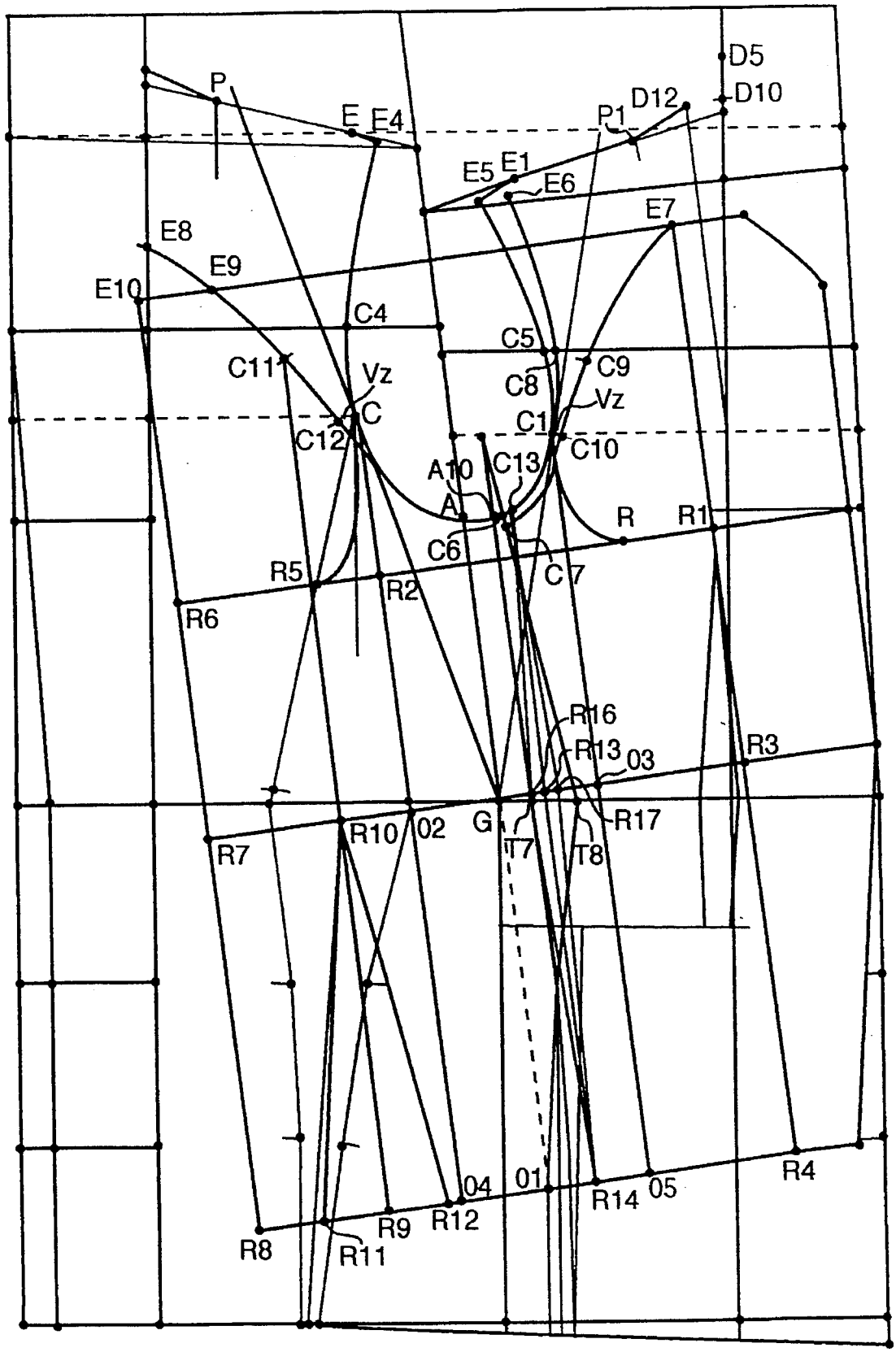
Figure 4:
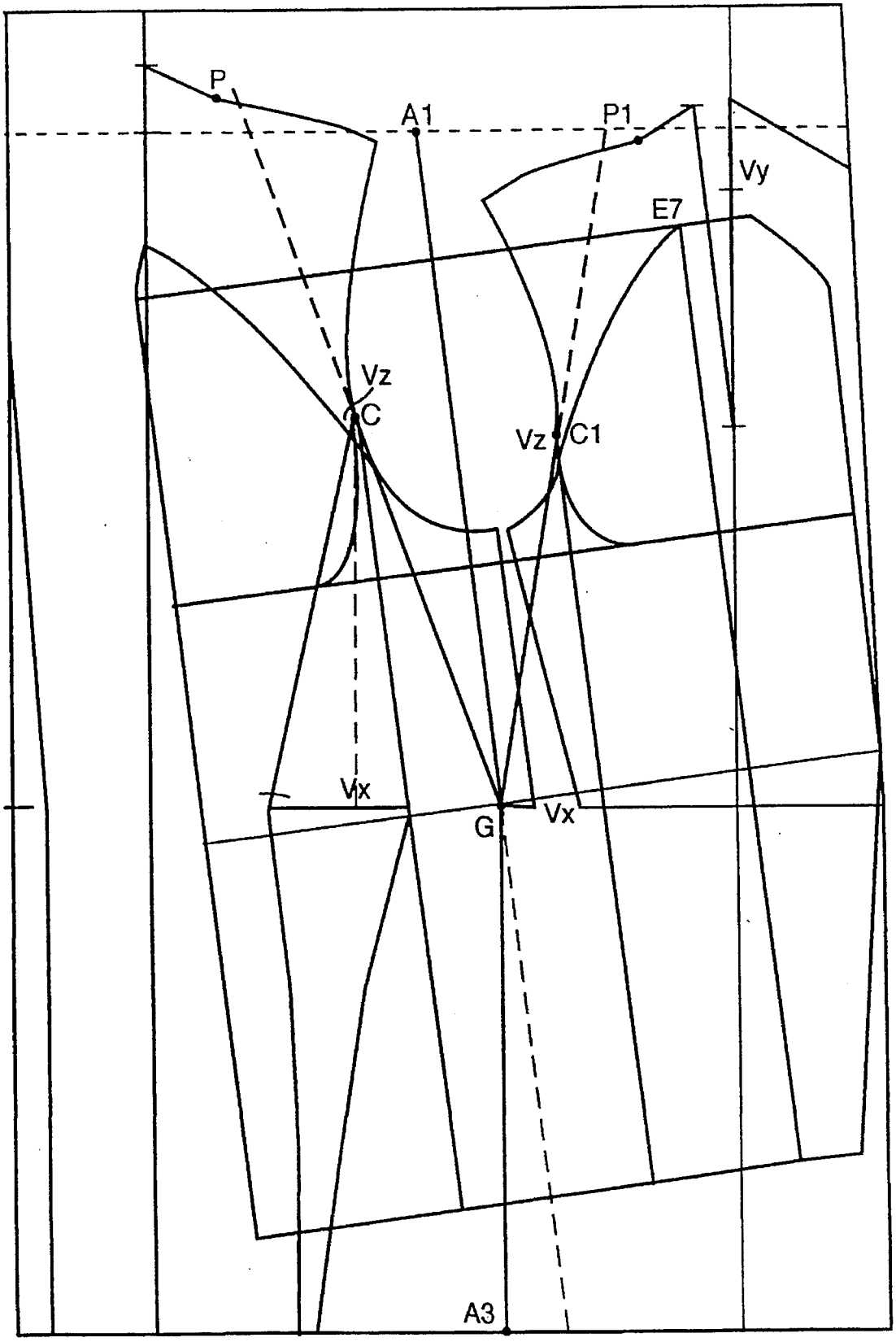

According to FIG. 3, in order to carry out accurate adjustment of joining the side front seam T7-A10 with the front side seam T8-C6, it is necessary to produce the operational line which follows, owing to the distinct difference in their respective length and this is so as to avoid any excess or fullness at the armhole/sleeve join. The line C-A-A10-C1 forms the bottom of the armhole, in perfect continuity. Its intersection with the front side seam T8-A9 is marked with the point C6.

With a sheet of tracing paper or transparent medium, the front side part C1-A10-A-T7 is marked. Next, using a pin pushed through C1 chosen as a pivot axis, the support is tilted towards the front side in order to place the previously marked point T7 on the point T8. Thus a new positioning of the point C6 is obtained at C7. When the two seams A10-T17 and C7-T8 have been joined together and closed, the armhole line C1-C7-A10-A will be in perfect continuity. At this stage in the construction, it will be noted that on the seam T8-C7, the distance C6-C7 proves excessive and must be eliminated from the future cut-out. This adjustment operation makes it possible to eliminate the puckering of the side front/side back of the garment which is all too often noticeable.

Adjustment of the armhole front after the bust dart has been taken in is carried out with the aid of a sheet of tracing paper or some other transparent medium. The armhole drawing C1-C5-E5, then the hanging point P1 and the neck length as far as the point D12 are marked. The sheet of tracing paper is turned over, marked on its wrong side and notched at the indicated points. Placed back in its initial position, and using the point C1 as a pivot, the sheet is turned over towards the center front. Where D12 meets the front straight grain line, the location of the drawing of the new armhole and the shift of the points C5 to C8 and E5 to E6 are marked by tracing off. The outline is then specified and fine-tuned using French curves, on the construction plan. The fact of shifting this armhole drawing forwards allows exact positioning, thus avoiding a very marked lack of sleeve head during subsequent assembly.

According to the invention, and as demonstrated a little later, the value denoted Vz is used for the relational calculation of the armhole/sleeve fitting. The value Vz is sought, for the front part, using the so-called transfer line and the front sleeve orientation line.

With the aid of a sheet of tracing paper or transparent medium marked with a right side and a wrong side, the front transfer line is marked from the point of gravity G towards the front hinge point C1 as is the start of the front armhole line E6-C8-C1. Then, from the front hinge point C1, part of the front sleeve orientation line C1-O3 is drawn towards the elbow length. Having turned the sheet of tracing paper over onto its wrong side, the traced point G is positioned on the initial point G allowing an overlap of the orientation line C1-O3 on the armhole curve C1-A to appear. Equipped with a pin fixed on the points G, the tracing paper medium is tilted towards the center front until the marked sleeve orientation line is tangential with the front armhole C1-A. Then, still using the tracing paper with its wrong side facing, the armhole drawing C1-A is marked in continuity using French curves. It is then possible to observe clearly the whole of the sleeve head/armhole/sleeve underarm part drawing line, the curve of which is transferred onto the construction plan via the points E6 which has become E7, C8 which has become C9 and C1 which has become C10. This line is in fact extracted, traced off and reconstructed directly from the armhole itself. According to the invention, it is an extremely accurate relational fitting calculation between the armhole defined by the points E5-C5-C1-A10 and A, the sleeve head E7-C9-C10 and the sleeve underarm part C10-A10-A.

Having completed this operation, the transfer medium is turned back onto its right side. With the points G superposed and the previously traced transfer line C1-O3 in the original position, the original mark of the sleeve underarm part C1-A is traced off. The point R taken from A, marks the end of this. Passing through this point, a perpendicular to the sleeve orientation line A-O1 can thus easily be drawn as far as the back sleeve orientation line C-O2 which it meets at R2. This straight line extends, after the point R, for a few centimeters towards the center front. In order to construct the rectangle of the sleeve starting from the sleeve head E7 towards the finished length, a parallel to the sleeve orientation line or body reference line A-O1 is drawn. Its intersection with the sleeve underarm part axis is marked with the point R1, its intersection with the extension of the elbow length axis O2-O3 is marked R3, and its intersection with the extension of the arm length axis O4-O5 is marked with the point R4.

The value Vz for the back part is sought by using the so-called transfer line and back sleeve orientation line. Before proceeding by analogy with the method employed for the front part, the outline of the central section of the length line M1-M9 and front sleeve orientation line from C5 to O3 is transferred onto tracing paper. After turning the tracing paper onto its wrong side and superposing the length line on its counterpart, the front sleeve orientation line thus reversed is positioned on the passage through the hinge point C and traced off onto the construction plan.

The relational calculation method for the back part is identical to the one used for the front part. In order to form the line thereof, the back transfer line G-C and the line passing through C, which line was previously obtained by transferring onto the back part the reversed front sleeve orientation line is marked on tracing paper. The back armhole drawing from the hinge point C to the half-length point C4 as far as the shoulder point E4 is also marked. This curve is redrawn on the wrong side of the medium in order to be traced off later. Then, using a pin, the tracing paper is pivoted about the point G chosen as an axis, towards the center back until the orientation line is tangential to the bottom of the armhole C-A. The location of the new point C12 originating from C is marked on the construction plan as is the section of armhole curve C12-A. The tracing paper or transfer medium is turned over onto its right side position and, positioning the point G on its counterpart, the bottom of the armhole curve C-A is traced off. The point A must then lie very precisely on the extension of R-R2 to R5. Next, with the transfer medium in its wrong side position and the axis G-C12 on its original counterpart, the top of the back sleeve curve is traced off, the transfer of the sleeve head E4 to E8 and the half-length point C4 to C11 are marked. It is thus possible to observe perfect continuity of the back armhole curve from E8 to the point level with the half-length C11 and of the transferral from the back hinge point C12 as far as the sleeve underarm part A. This line is thereby extracted, traced off and reconstructed directly based on the armhole itself. It is, according to the invention, the result of an extremely accurate relational fitting calculation between the armhole defined by the points E4-C4-C-A, the sleeve head E8-E9-C11-C12 and the sleeve underarm part C12-A.

The sleeve underarm part line R-R2-R5 is next extended by 150 mm approximately towards the center back. Then, starting from the front sleeve head point E7, a wide perpendicular to the sleeve orientation line A1-O1 is drawn. This straight line intersects the back armhole curve E8-A at E9. With the aid of a compass, the value E9-E8 is transferred onto this straight line at E9-E10. From the latter point is also transferred the total length of the sleeve E7-R4 as far as R8 towards the finished length. R3-O2 is then extended as far as R7 and R1-R5 is extended as far as R6. This line completes the drawing of the rectangle of the sleeve. The relational value Vz for the front part lies between the points C1 and C10. The relational value Vz for the back part lies between the points C and C12. At this stage in the preparation of the pattern, the shape and three-dimensional reality of the outline can be clearly observed. Indeed, when the sleeve piece thus cut out is rolled up on itself, the sleeve/armhole fitting will be obtained with extreme exactness. The technique of constructing garments has always run into the tricky problem posed by accurate fitting without ever managing to reach a truly effective solution. The search for the value Vz using the specific relational calculation presented, solves this problem perfectly.

As indicated before, this calculation is one of the fundamental characteristics of the method according to the invention detailed here.

In order to draw the elbow dart, a line parallel to the orientation line A1-O1 is drawn from the point C11 as far as the bottom of the sleeve at R9. It meets the elbow length at R10. The points R11 and R12 are situated 45 mm on either side of R10 on the sleeve length R4-R8. Next, R10-R11 and R10-R12 are linked. This line makes it possible to avoid too great a size and improves the aesthetics and comfort of the sleeve.

In order to draw the sleeve underarm bend seam, a line is drawn parallel to the sleeve orientation line A-O1 35 mm towards the center front. The point C13 marks its meeting with the bottom of the armhole. At its intersection with the elbow length R7-R3 and the sleeve length R8-R4 it is given the dots R13-R14. The points R16 and R17 are situated 7 mm on either side of R13 on the axis R7-R3. The outline is finished by linking the points C13-R16-R17 and R14-R16-R17.

The shifting and joining-together of the two sleeve top parts are carried out simply by transposing the drawing of the rear part formed by the points E10-R6-R7-R8-R11-R10-C11-E9 forwards on the basis of the axis E10-R8 shifted onto the center sleeve seam E7-R4. The exact outline relative to the armhole is thus established for the sleeve top by C13-R16-R14-R12-R10-C11-C12-A and C13, and then for the sleeve bottom by C13-R17-R14-R3-R1-E7-C9-C10 and C13. The unnumbered part is shifted and transposed from left to right, straight grain on straight grain, the sleeve top not having any seam in the center sleeve. The line E7-R4 will form the straight grain of the sleeve and the straight grain for the bottom will correspond to A-O1, reference line, initial basis for the whole of the outline.

In conclusion, this sleeve can be fitted into the armhole to within one millimeter. There will be no fullness at the underarm part or head and the designer will not have to correct or slacken off during assembly. The sleeve presented here is of the Italian style, fitted round with a flat head and of modern appearance. If the technician wishes to obtain a true tailored fit of sleeve then, for a degree of fullness determined right from the start, the required value from E7 and E10 will be added, that is 8 mm for lightweight fabrics and 12 to 15 mm for thick fabrics on either side of the sleeve head. The width R8-R4 at the bottom of the sleeve will remain identical to the initial outline.

In general, the present invention is designed for traditional and manual application and/or application using computerized tooling of the CAD/CAM (computer-aided design/computer-aided manufacture) type. Precise adoption of the recommended outline, of the specific measurements proposed, of the use of proportional and relational calculations linked to the reference values denoted Vx, Vy, Vz make it possible to produce very coherent universal patterns for men, women and children quickly and reliably under very accurate drawing, cutting-out and assembly conditions.

Although the method according to the invention is suitable for craftsman-type manufacture, it is particularly intended for the cottage-industry and industrial-scale making of garments.

What we claim is:

1. A method for designing three-dimensional patterns for pieces of garments with sleeves, especially jackets, blazers, coats, overcoats, dresses, shirts and blouses for men, women and children without any limitation in length and from any material with warp and weft, made of natural or synthetic fibers or of leather, according to which method a plurality of structural lines are drawn first of all, especially the waist line, the length lines, the neck lines, the hip line and the pelvis line, in which, in order to obtain a structural outline:

a theoretical axis of the profile of the bust is drawn by means of a line made of two segments, which is broken at a specific point known as the point of gravity, marking the angle of projection of the pelvis forwards and, by reaction, inclined backwards by 6° to 8° in its upper segment, said line constituting the fundamental reference line for constructing the garment, and being termed body line;

the specific position of the sleeve is determined symmetric to the upper segment of the reference line;

a first reference value is determined by drawing a theoretical straight line perpendicular to the waist line, this value lying between the point of intersection of this theoretical line and the waist line, and the point of intersection of the back sleeve orientation line and the waist line;

a specific and proportional geometric calculation is carried out on the fitting of the waist, using said first reference value;

a second reference value is determined on the center-front line using the difference lying between the points where it passes through the theoretical height of the neck back and the shoulder front line, this difference determining, in ordinates, the exact second reference value, a specific and proportional geometric calculation is carried out between the neck, top of neck and shoulder slope points with the aid of said second reference value;

a specific three-dimensional and relational geometric calculation is carried out on the armhole/sleeve fitting with the aid of curve transfer lines consisting of the tangents to the armhole originating from said point of gravity at the end of the line defining a third specific reference value;

two tension points denoted respectively back hanging point and front hanging point are determined, and these make it possible to fine-tune the fitting of the pattern in order to obtain integral fitting of the garment on the shoulder, through a specific calculation on the theoretical back shoulder slope at the intersection of a straight line originating from the center of the back shoulder line and perpendicular to the theoretical neck line, and the distance between said back hanging point and the point of intersection of the back shoulder line and of said upper segment of the body line is transferred onto the theoretical front shoulder slope starting from the point of intersection of the shoulder line and of said upper segment; and the bust dart value is specifically taken in making it possible to eliminate or use up any excess material depending on the desired volume;

and wherein all the components of the garment fall within the construction plan.

2. The method according to claim 1, wherein the body line is perpendicular to the waist line in its lower segment and inclined by 6° to 8° towards the rear of the torso relative to the vertical in its upper segment, and said point of gravity is situated on the waist line marking the length to the elbow.

3. The method according to claim 1, wherein the sleeve orientation lines may lie symmetrically on either side of the upper segment and of its lower extension or may vary, depending on the desired look, by face angles originating from a point on the front sleeve orientation line situated a quarter of the way up the length of the front, denoted front hinge point, to the following extents: 22.5°–30°–45°–67.5°–90°.

4. The method according to claim 1, wherein a proportional geometric calculation of the fitting of the back part is carried out in abscissa on the waist line by transferring three times said first reference value starting from said point of intersection of the theoretical line and of the waist line so as to determine a point, and by transferring once said first reference value for the fitting of the front part lying between two points, it being possible for the transfer of said first reference value to be less than or greater than the numbers written above, depending on the desired fit of the garment.

5. The method according to claim 1, wherein:

a proportional geometric calculation is carried out in order to determine, on said upper segment of the body line, the position of a back shoulder line by transferring the second reference value starting from a point of the front shoulder line;

a proportional geometric calculation is performed in order to determine, on the back straight grain line, the theoretical length of the back neck by transferring said second reference value vertically upwards starting from the point of intersection of the back shoulder line and of the back straight grain line;

a given distance is obtained lying, in the back part, on the back shoulder line between the center back line and the back straight grain line; and the second reference value is transferred vertically downwards onto the upper section of the front straight grain line starting from a given point on the front straight grain line in order to determine the theoretical front neck length, the latter given point of the front straight grain line being obtained by transferring said given distance vertically upwards onto the front straight grain line starting from the point of intersection of the front shoulder line and of the front straight grain line.

6. The method according to claim 1, wherein a relational geometric calculation is carried out on the armhole/sleeve fitting on the back part and front part based on the square of the armhole with the aid of two tangents to the armhole originating from said point of gravity, and denoted curve-transfer lines and their extensions, and with the aid of the back and front sleeve orientation lines, in that the above-mentioned lines are used to extract, transpose, and reconstruct the armhole curve towards the curve of the sleeve using a three-dimensional approach, and in that this calculation defines two separate relational values in the back and the front part, lying between the back hinge point and the transfer thereof onto the sleeve underarm part and between the front hinge point and the transfer thereof onto the sleeve underarm part.

7. The method according to claim 1, wherein a balanced value by which the bust dart is to be taken in is obtained starting from the point of intersection of two arcs of a circle centered respectively on the point of intersection of the front straight grain line and of the horizontal line passing through said front hinge point, and on the front shoulder point on the front shoulder slope.

8. The method according to claim 1, wherein a single outline incorporates all the components of the garment, a back, a front and a sleeve, within the construction plan.

* * * * *

UNITED STATES PATENT AND TRADEMARK OFFICE

CERTIFICATE OF CORRECTION

PATENT NO. : 5,619,799

DATED : April 15, 1997

INVENTOR(S) : Alexandre Kung Keung-Lung, Dominique Longavesne

It is certified that error appears in the above-identified patent and that said Letters Patent is hereby corrected as shown below:

Title Page under Item [19]:

delete "Keung-Lung et al." and insert --Kung Keung-Lung et al.--

Title Page under item [75]:

delete "Alexandre K. Keung-Lung" and insert --Alexandre Kung Keung-Lung--

Signed and Sealed this

Ninth Day of June, 1998

*Attest:*

*Attesting Officer*

BRUCE LEHMAN

*Commissioner of Patents and Trademarks*